United States Patent [19]

Helwerth et al.

[11] 4,323,476

[45] Apr. 6, 1982

[54] ANTICORROSIVE AGENT FOR ALUMINIUM AND ALUMINIUM ALLOYS

[75] Inventors: Rainer Helwerth, Eschborn; Horst Lorke, Liederbach, both of Fed. Rep. of Germany

[73] Assignee: Hoechst Aktiengesellschaft, Fed. Rep. of Germany

[21] Appl. No.: 169,362

[22] Filed: Jul. 16, 1980

[30] Foreign Application Priority Data

Jul. 20, 1979 [DE] Fed. Rep. of Germany ..... 2929413

[51] Int. Cl.[3] ..... C23F 11/16; C23F 11/14; C23F 11/12

[52] U.S. Cl. ..... 252/389 R; 106/14.41; 106/14.42; 106/14.43; 148/6.14 R; 252/391; 422/7

[58] Field of Search ..... 252/389 R, 391, 8.55 E; 106/14.26, 14.27, 14.31, 14.33, 14.41, 14.42, 14.43; 148/6.14 R; 422/7, 12, 16

[56] References Cited

U.S. PATENT DOCUMENTS 3,692,675 9/1972 Nimerick ..... 252/389 R
4,192,769 3/1980 Johnkp ..... 252/389 R

*Primary Examiner*—Benjamin R. Padgett
*Assistant Examiner*—Irwin Gluck
*Attorney, Agent, or Firm*—Connolly and Hutz

[57] ABSTRACT

Anticorrosive agent for aluminium and the alloys thereof consisting of (A) 15 to 50% by weight of a product obtained by reaction of sulfochlorination products of aliphatic, alkylaromatic, or cycloaliphatic hydrocarbons with ammonia or an alkyl or hydroxyalkyl amine with subsequent reaction with a halocarboxylic acid and conversion into an alkaline earth metal or the zinc salt, (B) 40 to 90% by weight of a paraffinic hydrocarbon, (C) 1 to 4% by weight of the salt of an alkyl amine and a carboxylic acid, (D) 1 to 4% by weight of an alkyl phenol oxethylate and (E) 1 to 2% by weight of a $C_4$–$C_8$ alkanol.

2 Claims, No Drawings

ANTICORROSIVE AGENT FOR ALUMINIUM AND ALUMINIUM ALLOYS

In the manufacture of profiles, i.e. the extrusion of structural elements from aluminium (window frames, wall facings and the like), the problem of so-called pre-corrosion does exist due to the high reactivity of the surfaces of freshly produced aluminium elements. The term pre-corrosion in the sense of this invention is intended to include all damages of the surfaces affecting the aspect, for example damages caused by hand perspiration, water or humidity, packing material and corrosive atmosphere on industrial sites prior to eloxation, which often require an expensive manual after-treatment of the finished elements. Anticorrosive agents used to avoid these damages should be stable up to 180° C. (annealing temperature) and they should not cause any problem in the following eloxal process. The products hitherto used are not fully satisfactory in these respects.

The present invention provides an improved anticorrosive agent for aluminium and the alloys thereof consisting of (A) 15 to 50, preferably 40 to 50%, by weight of a product obtained by reaction of sulfochlorination products of aliphatic, alkylaromatic or cycloaliphatic hydrocarbons having from 12 to 24 carbon atoms with ammonia or a $C_1$–$C_3$-alkyl or hydroxyalkylamine with subsequent reaction with a $C_2$–$C_{11}$ halocarboxylic acid and conversion into an alkaline earth metal or the zinc salt, (B) 40 to 90, preferably 40 to 50%, by weight of a paraffinic hydrocarbon containing from 50 to 60% of $C_{13}$–$C_{16}$ paraffins, 50 to 40% of naphthenes and 0 to 1% of aromatics and having a viscosity of from 3° to 5° E./20° C., (C) 1 to 4, preferably 1 to 2%, by weight of the salt of a $C_8$–$C_{10}$ alkyl amine and a $C_8$–$C_{10}$ carboxylic acid, (D) 1–4, preferably 1–2%, by weight of an oxethylate of 1 mol of a $C_8$–$C_{12}$alkylphenol and 2 to 10 mols of ethylene oxide and (E) 1 to 2% by weight of a $C_4$–$C_8$ aliphatic alcohol.

Component A of the anticorrosive agent according to the invention essentially consists of compounds of the formula $$RSO_2-\overset{\overset{R_2}{|}}{N}-(CH_2)_x-\overset{\overset{R_1}{|}}{CH}-COOY$$

in which R denotes a saturated, aliphatic, or cyclic hydrocarbon radical or an alkylaryl group having from 12 to 24, preferably 13 to 16, carbon atoms altogether, $R_1$ is hydrogen or $CH_3$, $R_2$ is hydrogen, $C_1$–$C_3$ alkyl, or hydroxyalkyl, X is zero or an integer from 1 to 9, Y is the equivalent of an alkaline earth metal cation or the zinc cation.

Reaction products of this type can be produced starting from sulfochlorination products of saturated, non-aromatic hydrocarbons, for example by the process described in German Patent 767,071.

Component B is a paraffinic hydrocarbon approximately consisting of 50 to 60% of $C_{13}$–$C_{16}$ aliphatic hydrocarbons, at most 1% of aromatic hydrocarbons and 40 to 50% of naphthenes and having a viscosity of about 0.8/15° C., a refractive index of about 1.4/20° C. and a flash point according to Abel-Pensky of about 100° C.

Component C is the amine salt of an organic acid, for example the salt of capryl amine, octyl amine, dibutyl amine, or isodecyl amine with caproic acid, caprylic acid, 2-ethyl-hexanoic acid, or isononanoic acid. The equivalent proportion of amine to acid is in the range of from 70:30 to 30:70.

Component D is, for example, the reaction product of nonyl phenol or tributyl phenol with 2 to 4 mols of ethylene oxide.

Component E is a solvent consisting of a linear or branched aliphatic $C_4$–$C_8$ alcohol.

The anticorrosive agents according to the invention are simply sprayed on the metal elements to be treated. The respective amounts of components A to E are chosen in the indicated limits to obtain a total amount of 100% of anticorrosive agent.

The advantageous anticorrosive effect of the agents of the invention is demonstrated by the following tests. In these tests dry, freshly pickled up aluminium sheets were sprayed with the respective anticorrosive agent and the sheets treated in this manner were examined under the conditions of the Kesternich Test (DIN 50,017) during a period of time of up to 4 weeks to determine their corrosion. The tendency to corrosion was also tested on aluminium sheets which had been sprayed with the anticorrosive agent and annealed for 4 hours at 180° C.

In the visual evaluation of the test sheets notes from 0 to 4 were given According to the following scheme:

0: no corrosion
1: traces of corrosion
2: slight corrosion
3: distinct corrosion
4: very pronounced corrosion The results obtained with anticorrosive agents 1 to 5 are summarized in the following table.

The following anticorrosive agents were used:

Agent (1) consisting 15% of a component A obtained by reaction of a $C_{13}$–$C_{16}$alkyl sulfochloride with ammonia with subsequent reaction with acetic acid and conversion into the barium salt, 80% of a paraffinic hydrocarbon approximately composed of 50 to 60% of $C_{13}$–$C_{16}$ aliphatic hydrocarbons, at most 1% of aromatic hydrocarbons and 50 to 40% of naphthenes and having a viscosity of about 0.8/15° C., a refractive index of about 1.4/20° C. and a flash point according to Abel-Pensky of about 100° C,
2% of capryl-aminooctoate,
2% of nonyl phenol with 2 mols of ethylene oxide and
1% of isobutanol.

Agent (2) consisting of
15% of component A as defined under (1), but in the form of its calcium salt,
80% of the paraffinic hydrocarbon as defined under (1),
2% of capryl-aminooctoate,
2% of nonyl phenol with 2 mols of ethylene oxide and
1% of isobutanol.

Agent (3) consisting of
4% of fatty acid esters from $C_{16}$–$C_{18}$ fatty acid having an iodine number of 27 with a fatty alcohol and low molecular weight polyhydric alcohols,
4% of fatty acid glyceride,
2% of alkanol amine salt of a sulfocarboxylic acid
90% of paraffin oil.

Agent (4) consisting of
a paraffinic hydrocarbon as used as component B in anticorrosive agents 1 and 2.

Agent 5 consisting of a mineral oil (spindle oil 3° E/30° C.).

Anticorrosive agents 1 and 2 correspond to the invention, while agents 3 and 4 have been used up to now.

TABLE

Anticorrosion Tests according to Kesternich (DIN 50,017)

| Anticorrosive agent | after 1 week | | after 2 weeks | | after 3 weeks | | after 4 weeks | |
|---|---|---|---|---|---|---|---|---|
| | a | b | a | b | a | b | a | b |
| 1 | 0 | 0 | 0 | 0 | 0 | 0 | 0 | 0 |
| 2 | 0 | 0 | 0 | 0 | 0 | 0 | 0 | 1 |
| 3 | 0 | 2 | 0 | 2 | 1 | 4 | 2 | 4 |
| 4 | 2 | 4 | 3 | 4 | 4 | 4 | 4 | 4 |
| 5 | 2 | 4 | 2 | 4 | 4 | 4 | 4 | 4 |

For the tests aluminium sheets having a magnesium content of 0.5; 1.5 and 3%, respectively, were used. The results obtained with the anticorrosive agents 1 to 5 were the same for all three types of alloy. The values listed sub b are the results obtained with sheets which had been annealed for 4 hours at 180° C. after spraying with the anticorrosive agent. The results a are those obtained without heat treatment.

We claim:

1. Anticorrosive agent for aluminium and the alloys thereof consisting of (A) 15 to 50% by weight of a product obtained by reaction of sulfochlorination products of aliphatic, alkylaromatic, or cycloaliphatic hydrocarbons having from 12 to 24 carbon atoms with ammonia or a $C_1$–$C_3$ alkyl or hydroxyalkyl amine with subsequent reaction with a $C_2$–$C_{11}$-halocarboxylic acid and conversion into an alkaline earth metal or the zinc salt, (B) 40 to 90% by weight of a paraffinic hydrocarbon containing from 50 to 60% of $C_{13}$–$C_{16}$ praffins, 50 to 40% of naphthenes and 0 to 1$ of aromatics and having a viscosity of from 3° to 5° E/20° C., (C) 1 to 4% by weight of the salt of a $C_8$–$C_{19}$ alkyl amine and a $C_8$–$C_{10}$ carboxylic acid, (D) 1–4% by weight of an oxethylate of 1 mol of a $C_8$–$C_{12}$ alkylphenol and 2 to 10 mols of ethylene oxide and (E) 1 to 2% by weight of a $C_4$–$C_8$ aliphatic alcohol.

2. Anticorrosive agent as claimed in claim 1, containing 40 to 50% by weight of component B, 1 to 2% by weight of component C, 1 to 2% by weight of component D and 1 to 2% by weight of component E.

* * * * *